United States Patent [19]

Wheeler

[11] Patent Number: 4,569,336

[45] Date of Patent: Feb. 11, 1986

[54] REHABILITATIVE TRAINING DEVICE

[76] Inventor: Jude Wheeler, 3553 Creekmur La., Lakeland, Fla. 33803

[21] Appl. No.: 689,380

[22] Filed: Jan. 7, 1985

[51] Int. Cl.[4] ..... A61H 1/02

[52] U.S. Cl. ..... 128/25 B; 272/70; 434/255

[58] Field of Search ..... 128/25 R, 25 B, 80 R, 128/80 B, 80 F; 272/70; 434/250, 255

[56] References Cited

U.S. PATENT DOCUMENTS

| | | | |
|---|---|---|---|
| 1,383,928 | 7/1921 | Gassette | 128/80 R |
| 2,010,482 | 8/1935 | Cobb | 128/80 R X |
| 2,536,454 | 1/1951 | McIntype | 128/80 G X |
| 3,750,659 | 8/1973 | Loomans | 128/80 R |

FOREIGN PATENT DOCUMENTS

| | | | |
|---|---|---|---|
| 551266 | 10/1956 | France | 434/255 |

*Primary Examiner*—Richard J. Apley
*Assistant Examiner*—David J. Brown
*Attorney, Agent, or Firm*—A. W. Fisher, III

[57] ABSTRACT

A rehabilitation training device for use by a patient and therapist where the patient has suffered partial or complete loss of function of one of his or her legs comprising a first and second foot support operatively coupled to each to permit limited movement therebetween, the first and second foot support each including a toe strap and heel/arch strap attached to the forward and rear portions thereof respectively to secure the foot of the disabled leg of the patient and therapist's opposite foot thereto and a substantially vertical elongated member including a pair of adjustable leg straps attached to the upper portion thereof to secure the rehabilitation training device to the patient's and therapist's leg pivotally attached between the rear portions of the first and second foot support such that the foot and leg of the disabled leg of the patient and opposite foot and leg of the therapist are attached to the rehabilitation training device whereby the therapist and patient walk in unison forcing the patient's nonfunctioning foot and leg to allow the motion of the therapist's opposite foot and leg thereby reinforcing the muscle and motor nerve response in the patient's nonfunctioning foot and leg.

12 Claims, 5 Drawing Figures

REHABILITATIVE TRAINING DEVICE

BACKGROUND OF THE INVENTION

1. Field of the Invention

A rehabilitation training device for use by a patient and therapist where the patient has sustained partial or complete loss of the function of one of his or her legs.

2. Description of the Prior Art

A number of braces, splints or supports have been developed for use in assisting a patient in using the lower extremities or for retraining in the use of the lower extremities. In addition, various sports training aids have been developed to teach the proper body movement.

Examples of various strap attachment means for the foot and leg areas are disclosed in Sichau, U.S. Pat. No. 3,805,773 and Andrews, U.S. Pat. No. 2,847,991. Hussey, U.S. Pat. No. 9,472 shows a similar strap or attachment arrangement and means for interlocking the feet by a single user.

Mest, U.S. Pat. No. 2,630,801; Perez, U.S. Pat. No. 2,760,774 and Craig, U.S. Pat. No. 2,906,261 disclose means to interlock a single user's foot. Jupiter, U.S. Pat. No. 2,754,121 shows a means of interlocking opposing feet of two individuals.

Remington, U.S. Pat. No. 1,530,519 and Bambrick, U.S. Pat. No. 1,854,392 disclose means of physical restraint to control the movement of the user's limbs to teach proper movement through biofeedback.

Kamenshine, U.S. Pat. No. 2,966,905 discloses an amublation training device whereby a patient's leg is physically moved by a therapist.

In addition, examples of the prior art are found in U.S. Pat. Nos. 1,548,771; 3,308,829; 3,750,659 and 4,252,112.

SUMMARY OF THE INVENTION

The present invention relates to a rehabilitation training device configured for use by a patient and therapist where the patient has suffered the loss of function of one of his or her legs.

The rehabilitation training device comprises a pair of foot support members in combination with a substantially vertical elongated member pivotally attached therebetween.

A toe strap and heel/arch strap are attached to the forward and rear portions respectively of each foot support member to secure the foot of the patient's nonfunctioning leg and the foot of the opposite leg of the therapist thereto.

A pair of vertically adjustable leg straps are mounted on the upper portion of the substantially vertical elongated member to secure the leg of the patient and therapist to the rehabilitation training device.

The rehabilitation training device includes an adjustment means to permit vertical adjustment of each vertically adjustable leg strap independent of each other along the longitudinal dimension or length of the substantially vertically elongated member. A bias comprising a resilient element may be provided to normally bias the substantially vertical elongated member in the forward position.

In use, the patient places his or her nonfunctioning foot on the foot support securing the foot thereto with the toe and heel/arch straps and the calf area by the vertically adjustable leg strap to the substantially vertical elongated member. The therapist places his or her leg and foot to the opposite foot support member in a similar manner.

The therapist and patient then walk in unison forcing the patient's nonfunctioning foot and leg to follow the motion of the therapist's opposite foot and leg thereby reinforcing the muscle and motor nerve response in the patient's nonfunctioning foot and leg.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
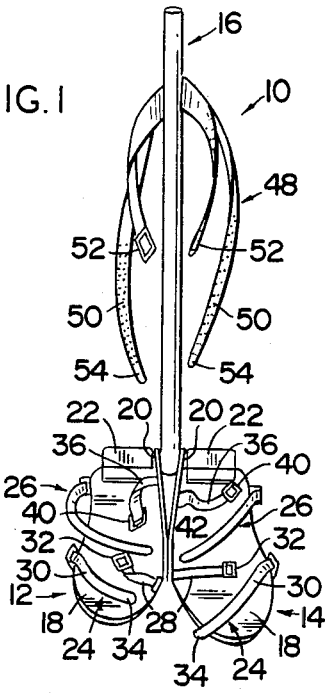
FIG. 1 is a perspective front view of the rehabilitation training device.
Figure 2:
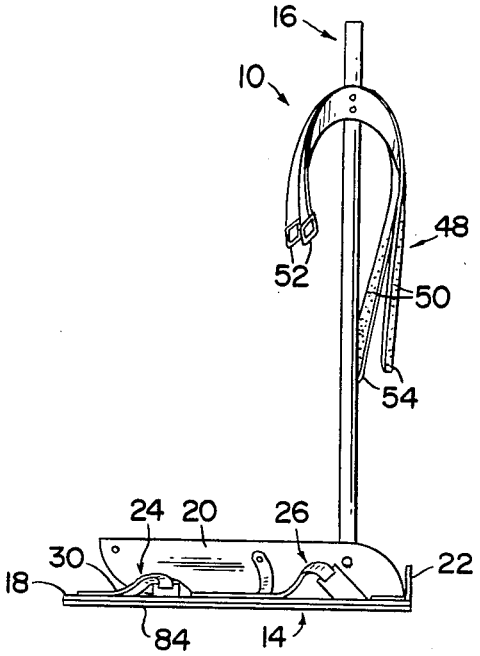
FIG. 2 is a perspective side view of the rehabilitation training device.

As shown in FIGS. 1 and 2, the present invention relates to a rehabilitation training device generally indicated as 10 configured for use by a patient and therapist where the patient has suffered the loss of function of one of his or her legs.

The rehabilitation training device 10 comprises a first and second foot support generally indicated as 12 and 14 respectively in combination with a substantially vertical elongated member generally indicated as 16 pivotally attached therebetween.

Figure 3:
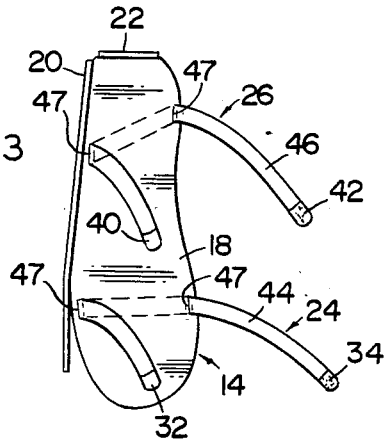
FIG. 3 is a top view of an alternate embodiment of the first and second foot support.

Both the first and second foot support 12 and 14 each comprises a foot support member 18 having a substantially flat lateral or side foot stop and arcuate rear foot stop indicated as 20 and 22 respectively extending upwardly from the inner side and rear portion of the foot support member 18 respectively to engage the side and rear respectively of the patient's and therapist's foot as more fully described hereinafter. A toe strap and heel/arch strap generally indicated as 24 and 26 respectively are attached to the forward and rear portions respectively of each foot support member 18 to secure the foot of the patient's nonfunctioning leg and the foot of the opposite leg of the therapist thereto. As shown in FIGS. 1 and 2, each toe strap 24 comprises a first and second flexible toe strap element indicated as 28 and 30 respectively affixed to the foot support member 18 having a first and second toe attachment element 32 and 34 respectively mounted on the free ends thereof respectively. The first and second toe attachment elements 32 and 34 may comprise a buckle combination, velcro combination or other suitable means of securing the free ends of the first and second toe attachment elements 32 and 34 together during use. Each heel/arch strap 26 comprises a first and second flexible heel/arch strap element indicated as 36 and 38 respectively affixed to the foot support member 18 having a first and second heel/arch attachment elements 40 and 42 respectively mounted on the free ends thereof respectively. The first and second heel/arch attachment elements 40 and 42 may comprise a buckle combination, velcro combination or other suitable means of securing the free ends of the first and second heel/arch attachment elements 40 and 42 together during use. Alternately as shown in FIG. 3, the toe strap 24 and heel/arch strap 26 may comprise a single flexible toe strap element and single flexible heel/arch strap element 44 and 46 respectively extending through a corresponding pair of slots 47 formed in each foot support member 18. The single flexible toe and heel/arch strap elements 44 and 46 include the first and second toe attachment elements 32/34 and the first and second heel/arch attachment elements 40/42 respectively.

Figure 4:
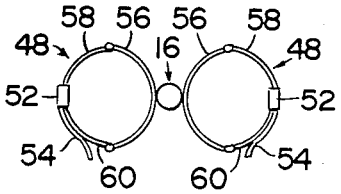
FIG. 4 is a top view of an alternate embodiment of the vertically adjustable leg strap.

As shown in FIGS. 1 and 2, a pair of vertically adjustable leg straps each generally indicated as 48 are mounted on the upper portion of the substantially vertical elongated member 16. Each vertically adjustable leg strap 48 comprises a single flexible leg strap element 50 having a first and second leg attachment element 52 and 54 respectively mounted on the free ends thereof. The first and second leg attachment elements 52 and 54 may comprise a buckle combination, velcro combination or other suitable means of securing the free ends of each single flexible leg strap element 50 together during use. Alternately as shown in FIG. 4, each vertically adjustable leg strap 48 may comprise a semi-rigid arcuate member 56 coupled to the substantially vertical elongated member 16 having a first and second flexible leg strap indicated as 58 and 60 respectively affixed thereto having the first and second leg attachment elements 52 and 54 mounted on the free ends thereof.

Figure 5:
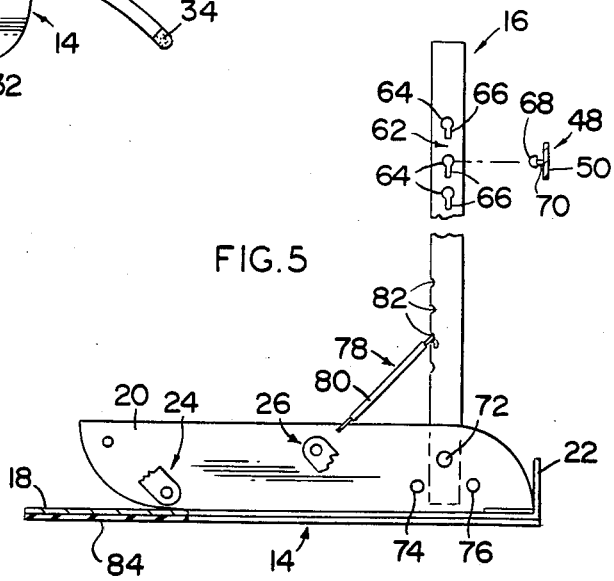
FIG. 5 is a partial detail side view of the substantially vertical elongated member, vertically adjustable leg strap and foot support member.

As shown in FIG. 5, the rehabilitation training device 10 includes adjustment means to permit vertical adjustment of each vertically adjustable leg strap 48 independent of each other along the longitudinal dimension or length of the substantially vertical elongated member 16. Specifically a plurality of adjustment slots each generally indicated as 62 is formed on opposite sides of the substantially vertical elongated member 16. Each adjustment slot 62 comprises an enlarged upper aperture and reduced lower aperture indicated as 64 and 66 respectively to receive an attachment member including an enlarged outer portion and reduced inner portion indicated as 68 and 70 respectively coupled to the single leg strap element 50 or semi-rigid arcuate member 56.

As shown in FIG. 5, the substantially vertical elongated member 16 is pivotally attached to each foot support member 18 by a coupling member 72 attached to and extending between the substantially flat lateral or side foot stops 20 of each foot support member 18. A front and rear limit stop indicated as 74 and 76 respectively are formed on the inner surface of the substantially flat lateral or side foot stops 20 to engage the front and rear surface of the substantially vertical enlongated member 16 respectively to limit the forward and rearward movement thereof.

As shown in FIG. 5, a bias generally indicated as 78 may be provided to normally bias the substantially vertical elongated member 16 in the forward position. The bias 78 may comprise a spring or other resilient element 80 extending between the substantially flat lateral or side foot stop 20 of the foot support member 18 and the substantially vertical elongated member 16. A plurality of apertures each indicated as 82 or other suitable fastening means are formed on the front of the substantially vertical elongated member 16 to permit selective adjustment of the tension on the resilient element 80. The bottom surface of each foot support member 18 may be surfaced with a sole or similar pad 84.

In use, the patient places his or her nonfunctioning foot on the foot support member 18, securing the foot thereto with the toe and heel/arch straps 24 and 26 and the calf area by the vertically adjustable leg strap 48 to the substantially vertical elongated member 16. The therapist places his/her leg and foot to the opposite foot support member 18 in a similar manner. The therapist and patient then walk in unison forcing the patient's nonfunctioning foot and leg to follow the motion of the therapist's opposite foot and leg thereby reinforcing the muscle and motor nerve response in the patient's nonfunctioning foot and leg. The vertically adjustable leg straps 48 are adjusted vertically independent of each other by inserting the enlarged outer portion 68 through the selected enlarged upper aperture 64 permitting downward movement of the reduced inner portion 70 within the corresponding reduced lower aperture 66.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A rehabilitation training device for use by a patient and therapist where the patient has suffered partial or complete loss of function of one of his or her legs comprising a first and second foot support operatively coupled to each to permit limited movement therebetween, said first and second foot support each including a toe strap and heel/arch strap attached to the forward and rear portions thereof respectively to secure the foot of the nonfunctioning leg of the patient and therapist's opposite foot thereto and a substantially vertical elongated member including a pair of leg straps attached to the upper portion thereof to secure said rehabilitation training device to the patient's and therapist's leg freely pivotally attached to said first and second foot support between the rear portions of said first and second foot support such that the foot and leg of the disabled leg of the patient and opposite foot and leg of the therapist are attached to said rehabilitation training device whereby the therapist and patient walk in unison forcing the patient's nonfunctioning foot and leg to follow the motion of the therapist's opposite foot and leg thereby reinforcing the muscle and motor nerve response in the patient's nonfunctioning foot and leg.

2. The rehabilitation training device of claim 1 wherein each said toe strap comprises a first and second flexible toe strap element coupled to said foot support member and having a first and second toe attachment element mounted on the free ends of said first and second flexible toe strap element to secure the free ends of said first and second toe attachment elements together during use.

3. The rehabilitation training device of claim 2 wherein each said heel/arch strap comprises a first and second flexible heel/arch strap element coupled to said foot support member having a first and second heel-/arch attachment element respectively mounted on the free ends thereof to secure the free ends of said first and second heel/arch strap elements together during use.

4. The rehabilitation training device of claim 1 wherein said toe strap and said heel/arch strap each comprises a single flexible toe strap element extending through a corresponding pair of slots formed in said foot support member and further including first and second attachment element formed on the free ends thereof to secure the free ends of said single flexible strap elements together during use.

5. The rehabilitation training device of claim 1 wherein each of said pair of leg straps comprises a single flexible leg strap element having a first and second leg attachment element formed on the free ends thereof to engage each other during use to secure said leg straps during use.

6. The rehabilitation training device of claim 1 including adjustment means to permit vertical adjustment of each of said leg straps independent of each other along the longitudinal dimension of said substantially vertical elongated member.

7. The rehabilitation training device of claim 6 wherein said adjustment means comprises a plurality of adjustment slots formed on opposite sides of said substantially vertical elongated member, each said adjustment slot comprising a enlarged upper aperture and reduced lower aperture to receive an attachment member formed on each said leg strap, said attachment member comprising an enlarged outer portion and reduced inner portion such that to secure each said leg strap to said substantially vertical elongated member said corresponding enlarged outer portion is inserted into one of said enlarged upper apertures and moved downward to permit said reduced inner portion to register said corresponding reduced lower aperture formed in said corresponding adjustment slot to secure said leg strap to said substantially vertical elongated member.

8. The rehabilitation training device of claim 1 wherein substantially vertical elongated member is pivotally attached between said foot support members by a coupling member attached thereto and extending therebetween.

9. The rehabilitation training device of claim 8 further including a front and rear limit stop formed on at least one of said foot support members to selectively engage the front and rear surface of said substantially vertical elongated member respectively to limit the forward and rearward movement thereof respectively.

10. The rehabilitation training device of claim 9 further including a bias to normally bias said substantially vertical elongated member in the forward position.

11. The rehabilitation training device of claim 10 wherein said bias comprises a resilient element extending between each said foot support member and said substantially vertical elongated member.

12. The rehabilitation training device of claim 10 wherein said bias is selectively coupled to said substantially vertical elongated member to permit selective coupling thereto along the longitudinal axis thereof to vary the tension of said resilient element.

* * * * *